US005778842A

United States Patent [19]

Schmidt et al.

[11] Patent Number: 5,778,842

[45] Date of Patent: Jul. 14, 1998

[54] ACTUATING LEVER FOR A VALVE DRIVE OF AN INTERNAL COMBUSTION ENGINE

[75] Inventors: Dieter Schmidt; Jürgen Kretschmer, both of Nürnberg, Germany

[73] Assignee: INA Wälzlager Schaeffler KG, Herzogenaurach, Germany

[21] Appl. No.: 846,150

[22] Filed: Apr. 25, 1997

[30] Foreign Application Priority Data

May 8, 1996 [DE] Germany ..... 1 96 18 416.9

[51] Int. Cl.[6] ..... F01L 1/18

[52] U.S. Cl. ..... 123/90.39; 123/90.36; 74/559

[58] Field of Search ..... 123/90.27, 90.39, 123/90.4, 90.44, 90.45, 90.46, 90.33, 90.36; 74/519, 559

[56] References Cited

U.S. PATENT DOCUMENTS

| | | | |
|---|---|---|---|
| 1,699,659 | 1/1929 | Fagan | 74/519 |
| 4,401,064 | 8/1983 | Nakamura et al. | 123/90.39 |
| 4,655,177 | 4/1987 | Wells et al. | 123/90.36 |
| 5,125,373 | 6/1992 | Yamada et al. | 123/90.36 |
| 5,186,128 | 2/1993 | Murata et al. | 123/90.39 |
| 5,596,958 | 1/1997 | Miller | 123/90.39 |

FOREIGN PATENT DOCUMENTS 0 663 514 A1 7/1995 European Pat. Off. .

OTHER PUBLICATIONS

Patent Abstracts of Japan, 63–18114 A, M–711, Jan. 1988, vol. 12, No. 218.

*Primary Examiner*—Weilun Lo
*Attorney, Agent, or Firm*—Henry M. Feiereisen

[57] ABSTRACT

A valve actuating lever for a valve drive of an internal combustion engine, includes a main body formed therein with a bore and a shaft received in the bore of the main body and defining a pivot axis about which the main body pivots, to thereby control up and down motions of a gas exchange valve in response to travel of a cam mechanism. The shaft has an outer surface area formed with tangential undercuts oriented transversely to the pivot axis and formed through non-cutting shaping process.

6 Claims, 1 Drawing Sheet

ACTUATING LEVER FOR A VALVE DRIVE OF AN INTERNAL COMBUSTION ENGINE

BACKGROUND OF THE INVENTION

The present invention refers to an actuating lever, especially to a rocker arm or swing lever, for a valve drive of an internal combustion engine, and in particular to an actuating lever of a type having a shaft pivotally mounted in a receiving bore of the lever and formed with a longitudinal bore, with the actuating lever interacting with a cam for controlling movement of a gas exchange valve.

European Pat. No. EP 0 663 514A1 describes an actuating lever in the form of a rocker arm which pivots about a rocker shaft formed on its peripheral surface with tangential undercuts for securement of the shaft to the cylinder head, with the shaft having diametrical throughholes which terminate at the circumferential area in the upwardly directed undercuts. These undercuts are milled portions that enable a secure contact of the screw heads upon the thus-formed flat bearing surface. A drawback of this type of rocker arm is the additional working step that is required to machine the flat undercuts and thereby the increased production costs involved for making such a valve drive.

Furthermore, there may be applications which require undercuts to point toward one side instead of being directed upwardly, in order to allow passage of screw fasteners for securement of a cylinder head upon a motor block. In the event, no arrangements were made for undercuts, the screw fasteners would not be insertable into the motor block as a result of the excessive radial expansion of the shaft of the rocker arm. Therefore, such rocker shafts typically are formed with an axial bore in order to ensure a lubrication of bearing zones of the valve drive and a lubricant supply to the hydraulic clearance compensation elements. A machining of the rotor shaft for providing the undercuts would however entail the risk of piercing the axial bore and thus result in oil losses and malfunction of the valve drive.

SUMMARY OF THE INVENTION

It is thus an object of the present invention to provide an improved actuating lever, obviating the afore-stated drawbacks.

In particular, it is an object of the present invention to provide an improved actuating lever which is pivotable about a shaft having formed therein undercuts in such a manner that their formation can be effected in a simple fashion, without adversely affecting the operativeness of the valve drive.

These objects, and others which will become apparent hereinafter, are attained in accordance with the present invention by forming the undercuts through a non-cutting process. Suitably, the shaft of the actuating lever is formed with an axial bore which exhibits a reduced cross section in an area of the undercuts.

According to another feature of the present invention, the shaft can be made from a pipe in a non-cutting manner through a drawing process.

Through non-cutting shaping, the undercuts can be made of any desired configuration. Although the inside cross section of the axial bore of the shaft may be reduced through material creep, there is no risk of piercing the axial bore. Moreover, the non-cutting shaping step of the undercuts can easily be integrated within the entire manufacturing process of the shaft, when making the shaft from a pipe in a non-cutting manner through a drawing process. The elimination of a machining step and substitution by a non-cutting shaping process for making the undercuts allows also the production of shafts at reduced wall thickness in lightweight construction.

According to another feature of the present invention, the undercuts are formed of arcuated configuration for passage of screw fasteners that connect the cylinder head and the motor block to one another and enable accessibility thereto. Formation of arcuated undercuts can easily be effected through impression by means of suitably shaped dies, whereby placement of a properly formed counter member within the shaft may be suitable.

According to another feature of the present invention, the shaft may have a reduced wall thickness in the area of the undercuts to thereby decrease the shaping work and facilitate formation of the undercuts.

In certain cases, it may be suitable to subject the undercuts to a subsequent machining process, e.g. in the form of a slight stripping or milling in order to enhance the dimensional stability of the valve drive through elimination of possible flash formation generated during impression.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
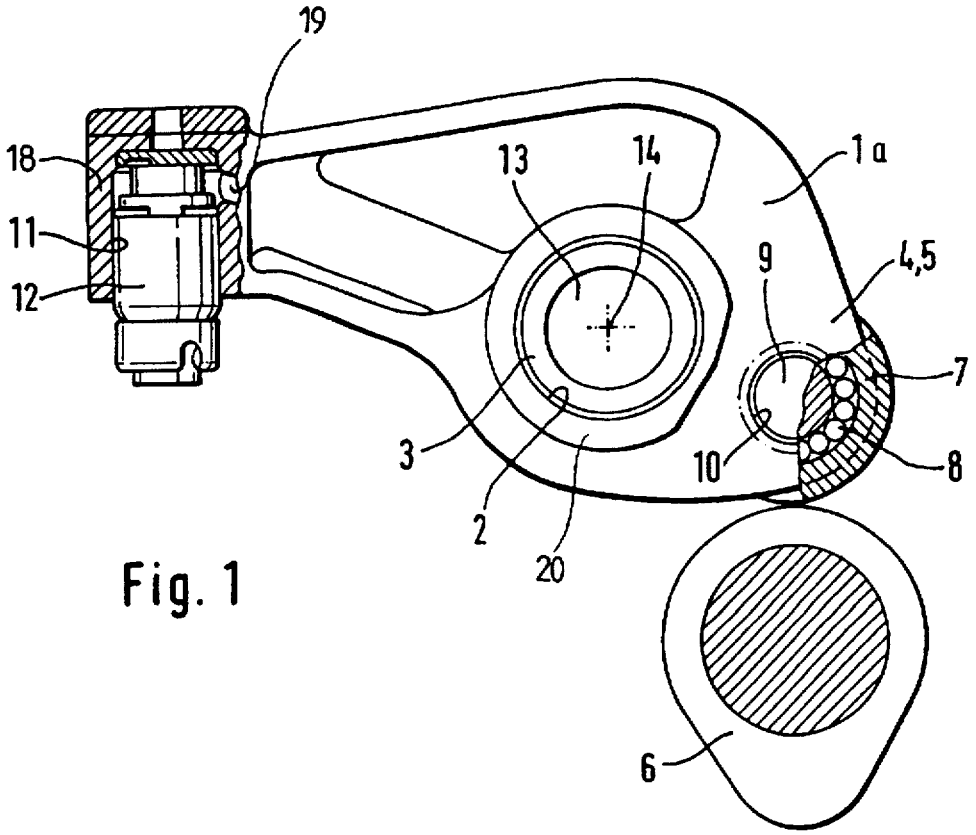
FIG. 1 is a partially sectional, side view of a valve actuating lever in form of a rocker arm in accordance with the present invention.

Throughout all the Figures, the same or corresponding elements are generally indicated by the same reference numerals.

Figure 2:
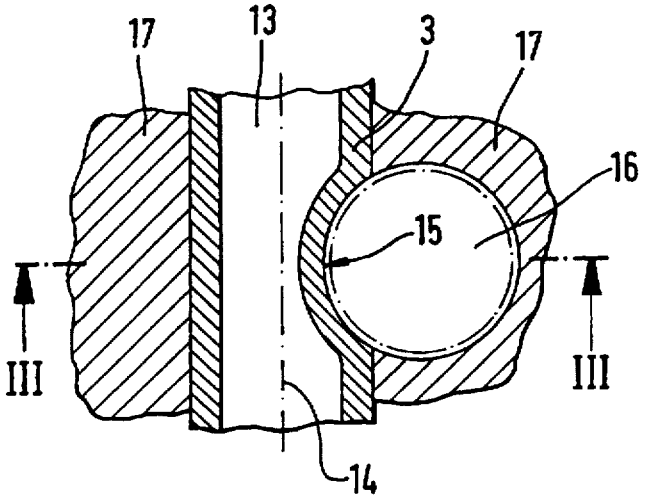
FIG. 2 is a cutaway sectional view through the rocker shaft of the rocker arm.

Turning now to the drawing, and in particular to FIG. 1, there is shown a partially sectional, side view of an actuating lever in form of a rocker arm in accordance with the present invention, generally designated by reference numeral 1 and forming part of a valve actuating mechanism of an internal combustion engine arranged in a cylinder head 17 (FIG. 2). The rocker arm 1 includes a main body 1*a* which is traversed at a central area thereof with a bore 2. Placed in the bore 2 is a bush 20 which receives a fixed hollow rocker shaft 3 formed therein with an axial bore 13 and defining a pivot axis 14 about which the rocker arm 1 pivots to control closing and opening operations of an engine valve such as a gas exchange valve.

At one end, the main body 1*a* of the rocker arm 1 is formed with a cavity which is bounded in axial direction by parallel side walls 4, 5 of the main body 1*a* for receiving a roller 7. The roller 7 is contacted by a cam 6 of a cam shaft (not shown) so that a rotation of the cam 6 causes the roller 7 to roll along the periphery of the cam 6, thereby actuating the gas exchange valve in up and down motions. The roller 7 is rotatably mounted via a needle bearing 8 on a pin 9 which is supported in pockets 10 of the side walls 4, 5. On the other end, the main body 1*a* of the rocker arm 1 is formed with a lash adjuster 18 which is formed with a circular bore 11 for receiving a valve stem 12 of the gas exchange valve. The lash adjuster 18 is fed via a supply bore 19 with pressure fluid which is suitably transferred from the lubricant circuit of the cylinder head 17.

Figure 3:
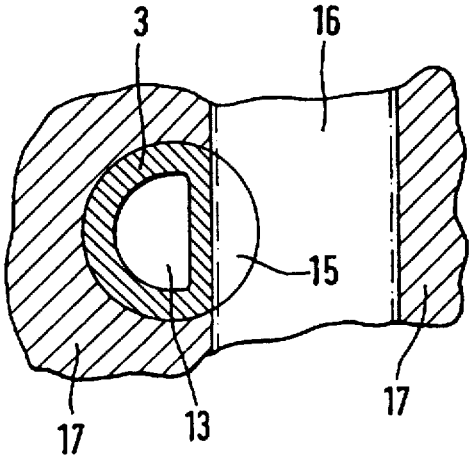
FIG. 3 is a sectional view of the rocker arm, taken along the line III—III in FIG. 2.

As shown in FIGS. 2 and 3, the rocker shaft 3 is formed with one or more undercuts 15 that are spaced from one another in direction of the axis 14 and formed laterally and exteriorly on the shaft 3 through a non-cutting procedure. Persons skilled in the art will understand that any conventional non-cutting process may be employed that is suitable to shape the shaft 3 with such undercuts 15. For example, the shaft 3 may be formed from a tube in which the undercuts are made by means of a suitably shaped die that is pressed onto the outside wall of the tube. Another example of a suitable non-cutting procedure is a drawing process. These non-cutting procedures are generally known so that a detailed description thereof is omitted for the sake of simplicity.

As best seen in FIG. 2, the undercuts 15 are arcuated to allow passage of screw fasteners 16 for securement of the cylinder head 17 upon a not shown motor block.

Persons skilled in the art will understand that the present invention should not be limited to an actuating lever in the form of a rocker arm, as described in connection with FIGS. 1 through 3, but is equally applicable for other types of actuating levers such as e.g. a swing lever.

While the invention has been illustrated and described as embodied in an actuating lever for a valve drive of an internal combustion engine, it is not intended to be limited to the details shown since various modifications and structural changes may be made without departing in any way from the spirit of the present invention.

What is claimed as new and desired to be protected by letters patent is set forth in the appended claims:

What is claimed is:

1. A valve actuating lever for a valve drive of an internal combustion engine, comprising:

a main body formed therein with a bore;

a tubular shaft received in the bore of the main body and defining a pivot axis about which the main body pivots, said shaft having an outer surface area provided with tangential arcuated undercuts which are oriented transversely to the pivot axis and adapted for passage of screw fasteners for allowing securement of a cylinder head upon a motor block, said undercuts being formed through non-cutting shaping, with the shaft exhibiting a reduced wall thickness in an area of the undercuts; and a cam mechanism interacting with the main body for controlling a gas exchange valve.

2. The lever of claim 1 wherein the shaft is formed with an axial bore which exhibits a reduced cross section in an area of the undercuts.

3. The lever of claim 1 wherein the tubular shaft is formed through a non-cutting drawing process.

4. The lever of claim 1 in the form of a rocker arm.

5. The lever of claim 1 in the form of a swing lever.

6. The lever of claim 1 wherein the undercuts are subjected to a subsequent machining process.

* * * * *